US006606071B2

(12) United States Patent
Cheng et al.

(10) Patent No.: US 6,606,071 B2
(45) Date of Patent: Aug. 12, 2003

(54) MULTIFREQUENCY ANTENNA WITH A SLOT-TYPE CONDUCTOR AND A STRIP-SHAPED CONDUCTOR

(75) Inventors: Wei-Li Cheng, Taipei Hsien (TW); Chien-Hsing Fang, Taipei Hsien (TW)

(73) Assignee: Wistron NeWeb Corporation, Taipei Hsien (TW)

( * ) Notice: Subject to any disclaimer, the term of this patent is extended or adjusted under 35 U.S.C. 154(b) by 0 days.

(21) Appl. No.: 09/683,362

(22) Filed: Dec. 18, 2001

(65) Prior Publication Data

US 2003/0112195 A1 Jun. 19, 2003

(51) Int. Cl.[7] ..... H01Q 13/10
(52) U.S. Cl. ..... 343/767; 343/700 MS
(58) Field of Search ..... 343/700 MS, 702, 343/767, 768, 769, 770, 846; H01Q 13/10

(56) References Cited

U.S. PATENT DOCUMENTS 5,754,143 A * 5/1998 Warnagiris et al. ..... 343/767
6,031,503 A * 2/2000 Preiss et al. ..... 343/770
6,339,400 B1 * 1/2002 Flint et al. ..... 343/702
6,373,442 B1 * 4/2002 Thomas et al. ..... 343/767
6,407,715 B1 * 6/2002 Chen ..... 343/767
6,414,642 B2 * 7/2002 Honda et al. ..... 343/702

* cited by examiner

*Primary Examiner*—Tho G. Phan
(74) *Attorney, Agent, or Firm*—Winston Hsu

(57) ABSTRACT

A multifrequency antenna for a wireless communications system includes a metallic plate having a slot. The slot is used for transmitting and receiving radio signals of a first frequency band. The length of the slot corresponds to the first frequency band at which signals are transmitted and received. The antenna also includes a metallic strip connected to the metallic plate for transmitting and receiving radio signals of a second frequency band. The metallic strip may be formed as an L-shaped strip. The length of the horizontal portion of the L-shaped strip corresponds to the second frequency band at which signals are transmitted and received.

16 Claims, 8 Drawing Sheets

MULTIFREQUENCY ANTENNA WITH A SLOT-TYPE CONDUCTOR AND A STRIP-SHAPED CONDUCTOR

BACKGROUND OF INVENTION

1. Field of the Invention

The present invention relates to a multifrequency antenna, and more particularly, to a multifrequency antenna containing a slot-type conductor and a strip-shaped conductor.

2. Description of the Prior Art

Recently, the demand for antennas in mobile wireless applications has increased dramatically. In order to increase the use and versatility of antennas, there is a need for a single antenna operable in two or more separate frequency bands. In addition, antennas need to have a small size in order to meet the size requirements of today's wireless devices.

U.S. Pat. No. 6,195,048 discloses a multifrequency planar inverted F antenna (PIFA). FIG. 1 is a perspective view of a prior art multifrequency planar inverted F antenna 10 disclosed in U.S. Pat. No. 6,195,048. For transmitting and receiving radio signals, the antenna 10 includes an emission conductor 12. The emission conductor 12 comprises a first emission conductor 17 and a second emission conductor 18 that resonate in respectively different frequency bands. The first emission conductor 17 and the second emission conductor 18 are separated by a cutout part 12*b* in the emission conductor 12. With this construction, the antenna 10 is capable of receiving radio waves of two different frequency bands: a first frequency band determined by the shape of first emission conductor 17 and a second frequency band determined by the shape of second emission conductor 18.

As shown, the first emission conductor 17 has a resonance length LA and the second emission conductor 18 has a resonance length LB. One end of the emission conductor 12 is connected to a ground conductor 11 through a short-circuit plate 13. Power is supplied to a single feeding point 12*a* of the emission conductor 12 by a coaxial feeding line 14 from power feeding source 15. The coaxial feeding line 14 is connected through a hole 11*a* provided in ground conductor 11.

With this construction, the antenna 10 resonates in a first frequency band corresponding to length LA of the first emission conductor 17. LA is approximately equal to lambda1/4, where lambda1 is the wavelength of the first frequency. The antenna 10 also resonates in a second frequency band corresponding to length LB of the second emission conductor 18. LB is approximately equal to lambda2/4, where lambda2 is the wavelength of the second frequency. As a result of using the first emission conductor 17 and the second emission conductor 18, the antenna 10 is capable of receiving radio waves of two frequency bands.

However, the prior art antenna 10 uses the short-circuit plate 13 to connect one end of the emission conductor 12 to the ground conductor 11. The use of the short-circuit plate 13 adds extra height, and therefore extra volume, to the antenna 10.

SUMMARY OF INVENTON

It is therefore a primary objective of the claimed invention to provide a multifrequency antenna with a slot-type conductor and a strip-shaped conductor to solve the above-mentioned problems.

According to the claimed invention, the antenna comprises a metallic plate having a slot. The slot is used to transmit and receive radio signals of a first frequency band. The antenna further comprises a metallic strip connected to the metallic plate for transmitting and receiving radio signals of a second frequency band.

It is an advantage of the claimed invention that the antenna uses both the slot and the metallic strip in order to provide a multifrequency antenna with a smaller height in order to overcome the prior art shortcomings.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
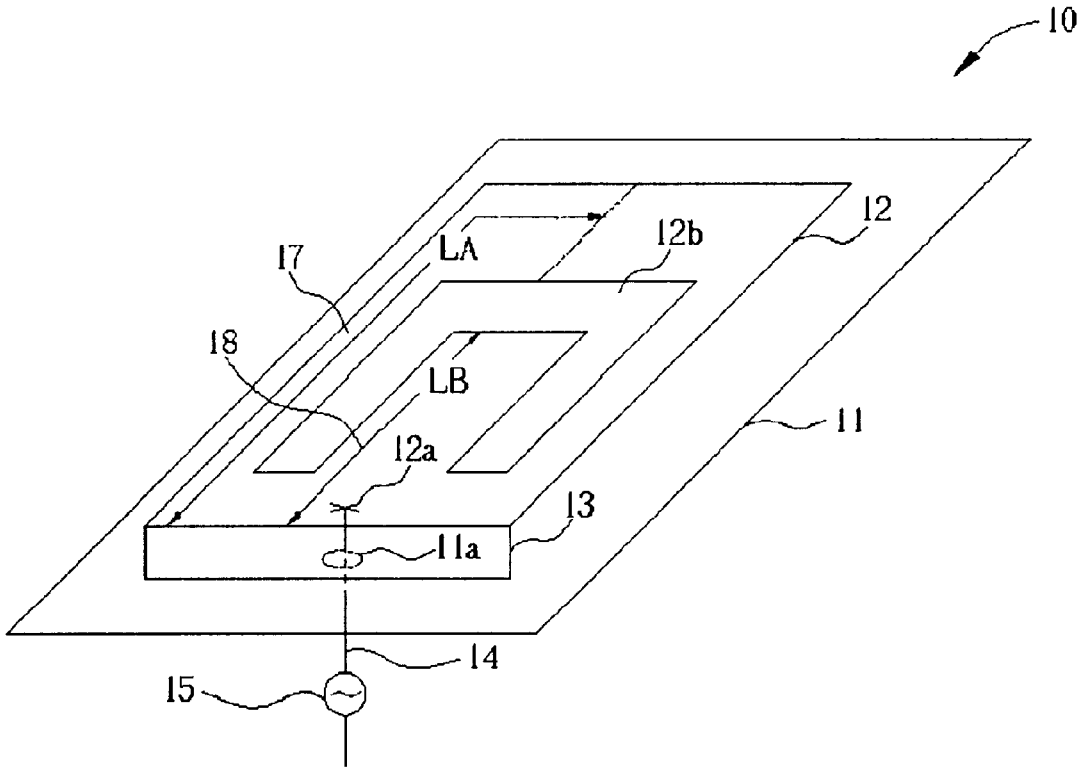
Fig. 1 Prior art
FIG. 1 is a perspective view of a multifrequency planar inverted F antenna according to the prior art.
Figure 2:
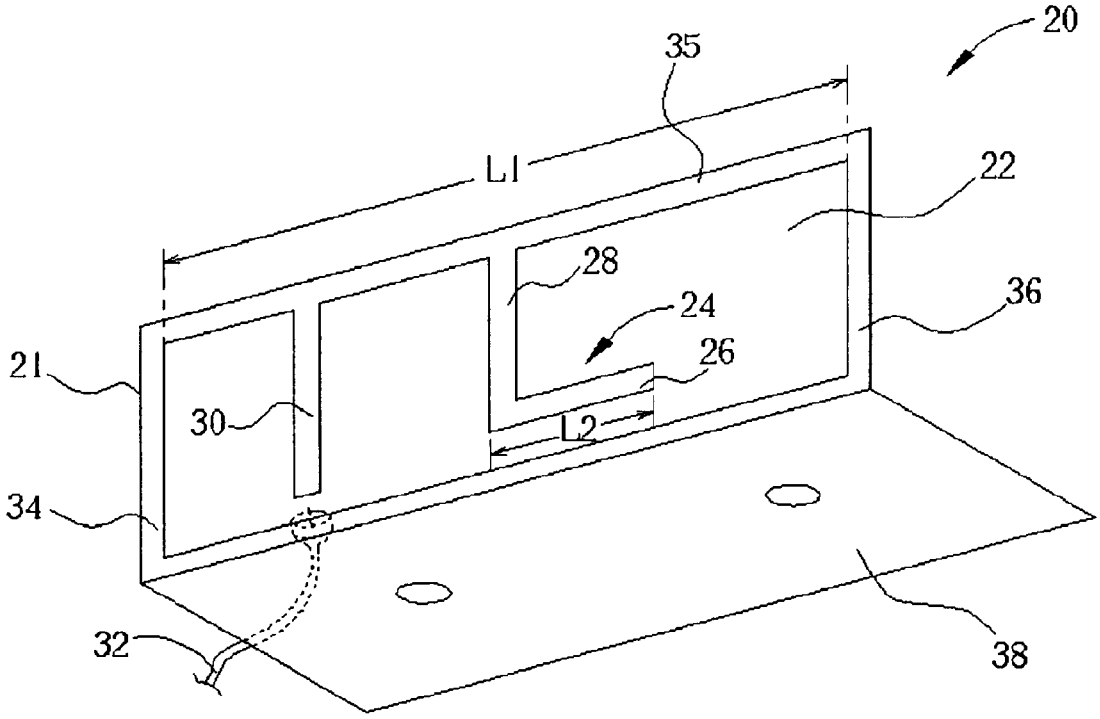
FIG. 2 is a perspective view of a multifrequency antenna containing a slot-type conductor and a strip-type conductor according to the first embodiment of the present invention.

Please refer to FIG. 2. FIG. 2 is a perspective view of a multifrequency antenna 20 containing a slot 22 and an L-shaped strip 24 according to the first embodiment of the present invention. The antenna 20 comprises a metallic plate 21, which includes the slot 22 for transmitting and receiving radio signals of a first frequency band. The slot 22 has a length L1 that is approximately equal to lambda1/2, where lambda1 is the wavelength of radio signals of the first frequency band. In this particular case, the length L1 of the slot 22 corresponds to half a wavelength of radio signals in the first frequency band. However, the length L1 of the slot 22 could also correspond to another fraction of the wavelength of radio signals in the first frequency band such as a quarter of the wavelength.

The antenna 20 further comprises a feed strip 30 that is connected to the metallic plate 21, and the L-shaped strip 24 that is also connected to the metallic plate 21. Both the feed strip 30 and the L-shaped strip 24 are made out of conductive metal. The feed strip 30 is fed by a feed line 32 across the slot 22 for feeding radio signals to the feed strip 30 and for receiving radio signals from the feed strip 30. The feed line 32 connects to a feeding point on the feed strip 30. The L-shaped strip 24 includes a horizontal strip 26 of length L2 and a vertical strip 28. The vertical strip 28 has an end connected to the metallic plate 21, and in this particular embodiment, the feed strip 30 and the vertical strip 28 of the L-shaped strip 24 both connect to a same side of the metallic plate 21. Yet, if so desired, the vertical strip 28 and the feed strip 30 may be connected to different sides of the metallic plate 21. The horizontal strip 26 is used for transmitting and receiving radio signals of a second frequency band. The length L2 of the horizontal strip 26 is approximately equal to lambda2/4, where lambda2 is the wavelength of radio signals of the second frequency band.

The metallic plate 21 has three side strips 34, 35, 36 and a ground strip 38 surrounding the slot 22 to give the slot 22 a shape of a rectangle. In this embodiment of the present invention, the metallic plate 21 is bent in a manner such that the ground strip 38 lies in a different plane than a plane shared by the three side strips 34, 35, 36. The metallic plate 21 can be bent at any angle desired, or not bent at all, in order to satisfy size requirements.

What distinguishes the present invention antenna 20 from the prior art antenna 10 is the use of both the slot 22 and the L-shaped strip 24 for transmitting and receiving radio signals. Like the prior art antenna 10, the L-shaped strip 24 and the feed strip 30 form an antenna structure which functions in a way similar to an inverted F antenna that transmits and receives radio signals corresponding to L2=lambda2/4. However, the present invention antenna 20 also uses the slot 22, which transmits and receives radio signals corresponding to L1=lambda1/2. Instead of solely relying upon the PIFA structure to realize a multifrequency antenna, the present invention antenna 20 uses a combination of the inverted F antenna structure and the slot antenna structure to form another type of multifrequency antenna. Because in this first embodiment the L-shaped strip 24 is formed inside the slot 22, it is clear that the length L1 of the slot 22 must be greater than the length L2 of the horizontal strip 26.

Figure 3:
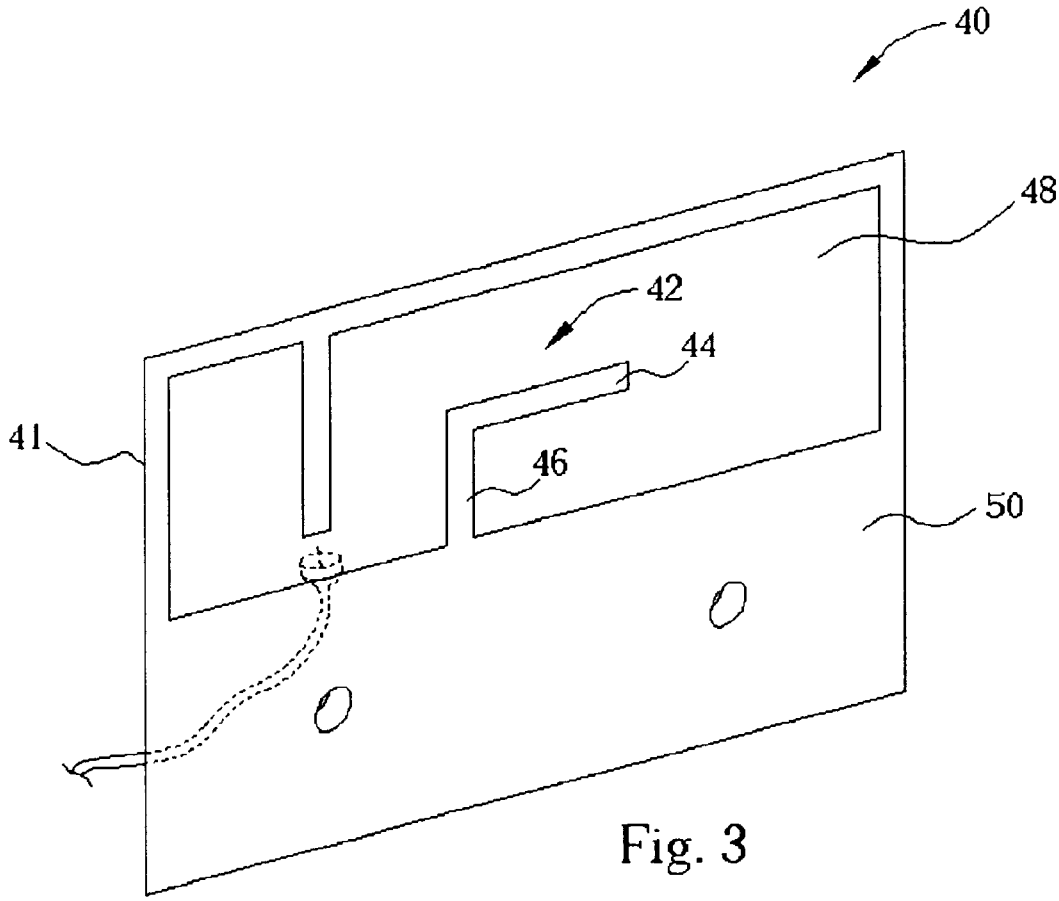
FIG. 3 to FIG. 8 are perspective views of multifrequency antennas according to the second through seventh embodiments of the present invention.

Please refer to FIG. 3. FIG. 3 is a perspective view of another multifrequency antenna 40 according to the second embodiment of the present invention. Like before, the antenna 40 comprises a metallic plate 41 including a slot 48. The slot 48 also has an L-shaped strip 42 with a horizontal strip 44 and a vertical strip 46. In addition, the metallic plate 41 contains a ground strip 50 on one side of the slot 48. The antenna 40 is very similar to the antenna 20 from FIG. 2, and only has two major differences. The first difference is the portion of the metallic plate 41 containing the ground strip 50 is not bent in this embodiment. The other difference concerns a location of the L-shaped strip 42. Specifically, the vertical strip 46 of the L-shaped strip 42 is now connected to the ground strip 50 of the metallic plate 41. In fact, the L-shaped strip 42 of the antenna 40 may be connected to any portion of the metallic plate 41. Furthermore, the strip 42, though being L-shaped in the present embodiment, can have an arbitrary shape and size, be either parallel or at any three-dimensional angle with respect to the slot 48, can lie outside of the slot 48, and lie either in a same plane or in a different plane as the slot 48, so long as wave resonance can be created and communication frequency characteristics remain desired.

Figure 4:
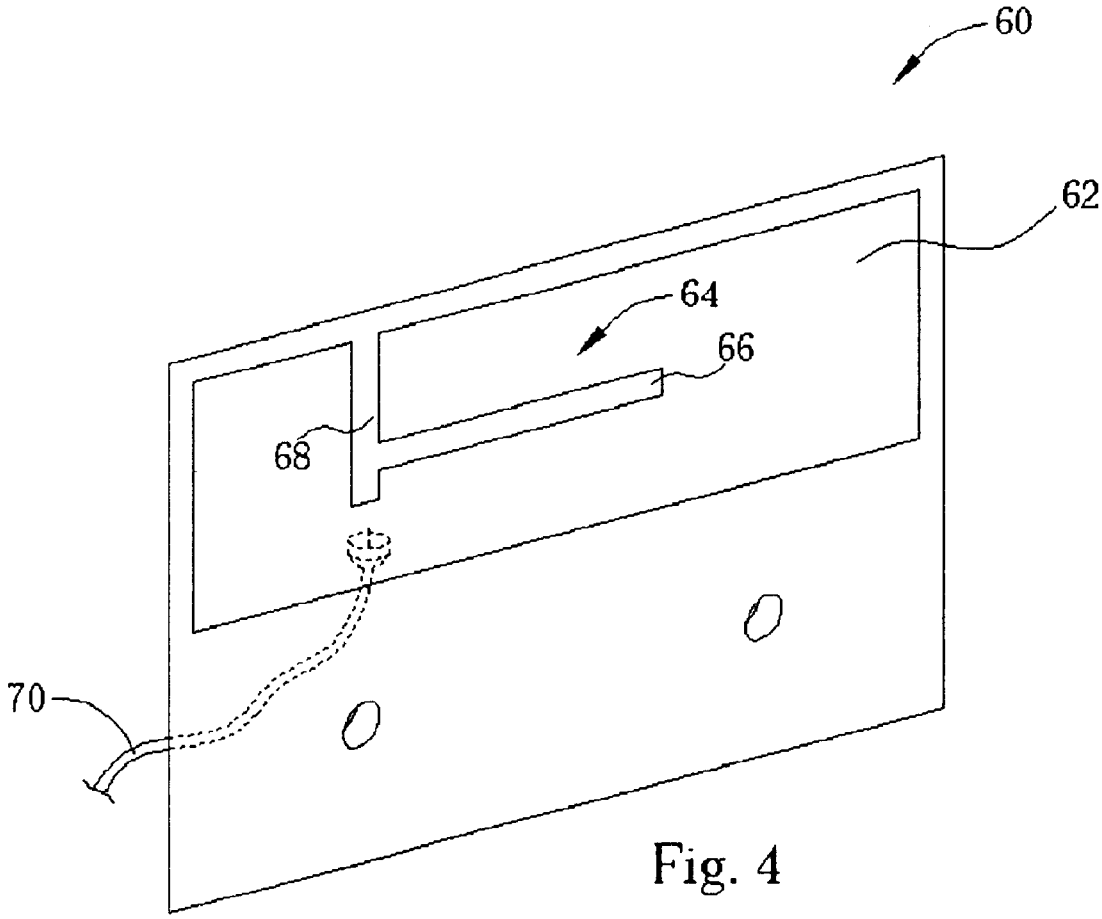

Please refer to FIG. 4 with reference to FIG. 2. FIG. 4 is a perspective view of another multifrequency antenna 60 according to the third embodiment of the present invention. Like before, the antenna 60 comprises a slot 62. The slot 62 includes an L-shaped strip 64 with a horizontal strip 66 and a vertical strip 68. However, unlike the antenna 20 of FIG. 2, the antenna 60 does not contain the feed strip 30 in addition to the L-shaped strip 24. Instead, the antenna 60 uses the L-shaped strip 64 to combine functionality of both the feed strip 30 and the L-shaped strip 24. Notice that the L-shaped strip 64 has a feed line 70 attached to the vertical strip 68 for transmitting and receiving radio signals. Since the horizontal strip 66 determines a second frequency band, the vertical strip 68 can be employed to connect to the feed line 70 directly, providing a simpler design of the antenna 60.

In addition to the three embodiments described above, the present invention allows for other implementations of the multifrequency antenna. For example, the slot can be of any desired shape other than a rectangle so long as the frequency characteristics remain in place. Moreover, transmitting and receiving in more than two frequency bands can be achieved by the addition of other elongated strips to the antenna. In this way, either a dual-band antenna or multifrequency antenna can be created.

Figure 5:
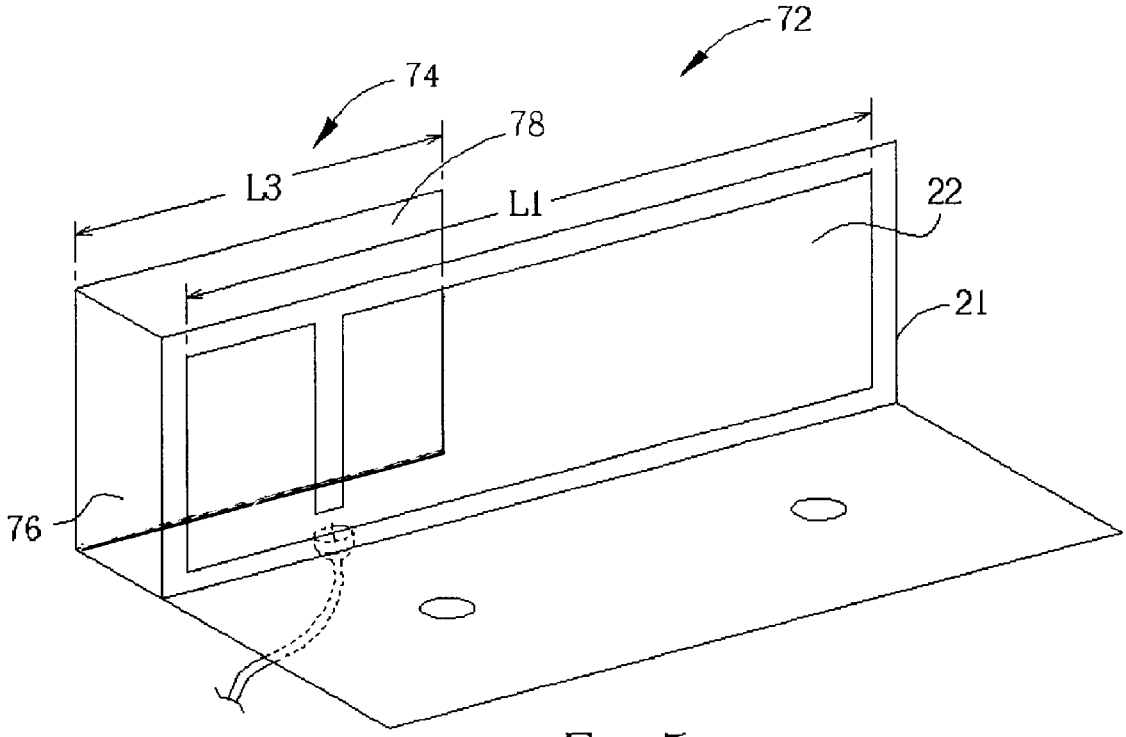

Please refer to FIG. 5. FIG. 5 is a perspective view of another multifrequency antenna 72 according to the fourth embodiment of the present invention. An L-shaped metallic strip 74 has an extending section 76 connected to the metallic plate 21. The metallic strip 74 also has a resonating section 78 connected to the extending section 76. The main difference between the antenna 72 shown in FIG. 5 and other antennas shown is that the metallic strip 74 lies outside the slot 22 and is positioned in space. In addition, the metallic strip 74 is three dimensional instead of lying in one plane like before. The resonating section 78 has a length L3 that corresponds to a frequency at which the metallic strip 74 is able to transmit and receive radio signals. Like before, the length L1 of the slot 22 is used to transmit and receive at another frequency. Therefore, the antenna 74 shown in FIG. 5 is a dual-frequency antenna.

Figure 6:
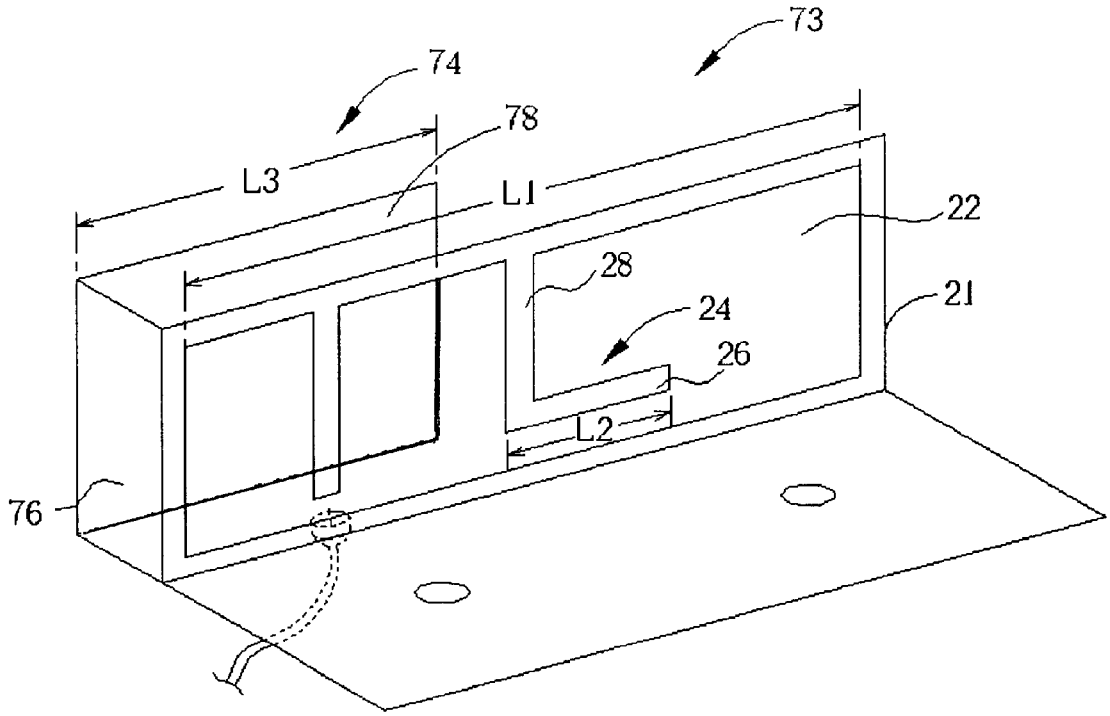

Please refer to FIG. 6. FIG. 6 is a perspective view of another multifrequency antenna 73 according to the fifth embodiment of the present invention. The antenna 73 uses a combination of the features in the antenna 20 from FIG. 2 and the antenna 72 from FIG. 5. The only difference over the antenna 72 is the inclusion of the L-shaped strip 24. By using the slot 22, the L-shaped strip 24, and the metallic strip 74, the antenna 73 is able to transmit and receive radio signals at three frequencies. Furthermore, additional metallic strips 74 could be added to the antenna 73 for transmitting and receiving at even more frequencies. FIGS. 5 and 6 are shown to illustrate an additional way to form multifrequency antennas according to the present invention. Although the use of the metallic strip 74 adds volume to the antennas 72, 73, it provides an additional design option of the antennas 72, 73.

Figure 7:
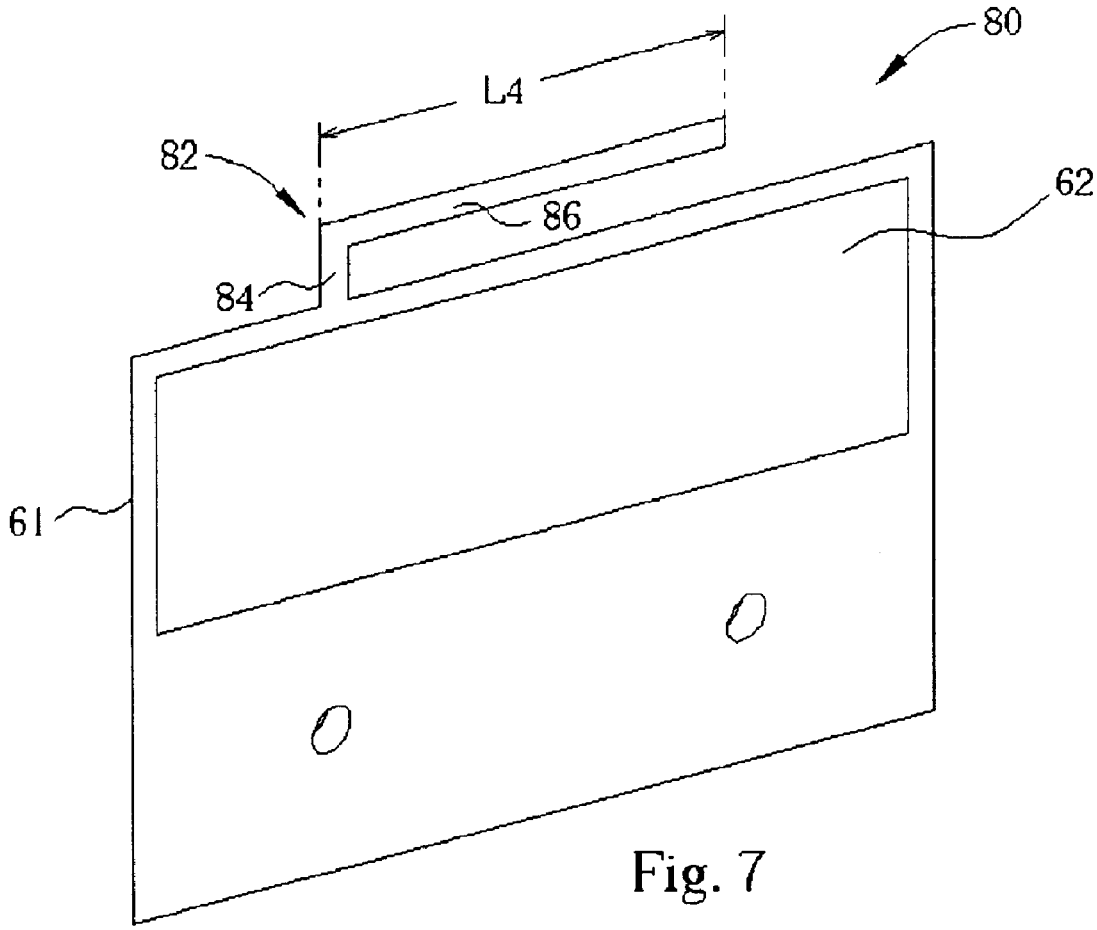

Please refer to FIG. 7. FIG. 7 is a perspective view of another multifrequency antenna 80 according to the sixth embodiment of the present invention. This embodiment shows an external L-shaped strip 82 lying outside the slot 62. The L-shaped strip 82 has an extending section 84 with one end connected to a section of a metallic plate 61. The L-shaped strip also has a resonating section 86 for transmitting and receiving radio signals corresponding to a length L4 of the resonating section. The antenna 80 uses the L-shaped strip 82 together with the slot 62 to form a dual-frequency antenna.

Figure 8:
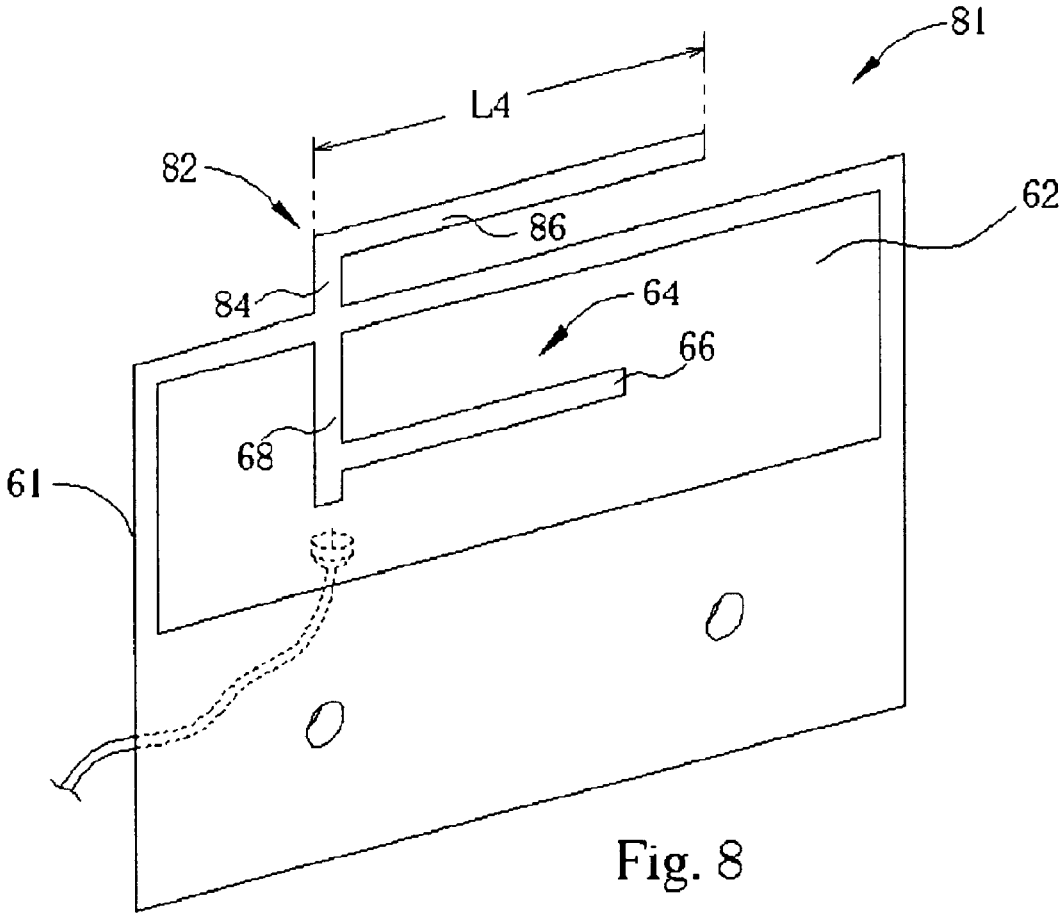

Please refer to FIG. 8. FIG. 8 is a perspective view of another multifrequency antenna 81 according to the seventh embodiment of the present invention. The antenna 81 combines the features shown in the antenna 60 from FIG. 4 and the antenna 80 shown in FIG. 7. Specifically, the antenna uses the external L-shaped strip 82, the L-shaped strip 64, and the slot 62 to transmit and receive radio signals at three frequencies. Additional external L-shaped strips 82 could also be added to facilitate transmitting and receiving at even more frequencies. Although the use of the external L-shaped strip 82 adds surface area to the antenna 81, it provides an additional design option of the antenna 81. To help minimize the volume of the antenna 81, the external L-shaped strip 82 could be positioned inside the slot 62 so long as there is no interference with the L-shaped strip 64 lying inside the slot 62.

In contrast to the prior art, wherein the antenna structure is purely of PIFA type, the multifrequency antenna according to the present invention uses both the slot, which functions in accordance with a slot-type antenna, and the metallic strip, which can be considered as a variation of an inverted F antenna, in order to provide a multifrequency antenna with a smaller height in order to effectively reduce the volume of the antenna.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A multifrequency antenna for a wireless communications system comprising:

a metallic plate comprising a ground strip and an elongated slot;

an elongated conductive feed strip attached to the metallic plate and extending lengthwise within and across at least a portion of a width of the slot;

a first elongated conductive strip attached to the metallic plate and extending lengthwise within and across at least a portion of the width of the slot;

a second elongated conductive strip attached to the first elongated conductive strip and extending lengthwise within and across at least a portion of a length of the slot; and a feedline connected to the conductive feed strip for feeding radio signals to the feed strip and for receiving radio signals from the feed strip.

2. The multifrequency antenna of claim 1 wherein the feed line is connected with the metallic plate and the conductive feed strip for feeding radio signals to the multifrequency antenna.

3. The multifrequency antenna of claim 1 wherein the first conductive strip and the second conductive strip form an L-shaped strip with one end connected to the metallic plate, the second conductive strip for transmitting and receiving radio signals of a second frequency band.

4. The multifrequency antenna of claim 3 wherein the slot defines a slot antenna for transmitting and receiving radio signals of a first frequency band.

5. The multifrequency antenna of claim 1 wherein the metallic plate has four side strips, the slot being formed inside the side strips and having a rectangular shape.

6. The multifrequency antenna of claim 5 wherein the conductive feed strip and the first conductive strip are connected to the same side strip of the metallic plate.

7. The multifrequency antenna of claim 5 wherein the conductive feed strip and the first conductive strip are connected to different side strips of the metallic plate.

8. The multifrequency antenna of claim 5 wherein one of the side strips is the ground strip.

9. The multifrequency antenna of claim 8 wherein the metallic plate is bent such that the ground strip is in a different plane than a plane of the remaining three side strips.

10. The the multifrequency antenna of claim 1 wherein the slot and the first conductive strip are formed in the same plane.

11. The multifrequency antenna of claim 1, wherein the slot creates half-wave resonance.

12. The multifrequency antenna of claim 1, wherein the second conductive strip creates quarter-wave resonance.

13. A multifrequency antenna for a wireless communications system comprising:

a metallic plate comprising a ground strip and an elongated slot;

a first elongated conductive strip attached to the metallic plate and extending lengthwise within and across at least a portion of a width of the slot;

a second elongated conductive strip attached to first elongated conductive strip and extending lengthwise within and across at least a portion of a length of the slot; and a feed line connected to the first conductive strip for feeding radio signals to the first conductive strip and for receiving radio signals from the first conductive strip.

14. The multifrequency antenna of claim 13 wherein the feed line is connected with the metallic plate and the first conductive strip for feeding radio signals to the multifrequency antenna.

15. The multifrequency antenna of claim 13 further comprising a radiation conductor connected with the metallic plate, the radiation conductor for transmitting and receiving radio signals within a first frequency range and the second conductive strip for transmiting and receiving radio signals within a second frequency range outside the first frequency range.

16. A multifrequency antenna for a wireless communications system comprising:

a conductive layer comprising a ground strip and edges that define a internal elongated slot;

an elongated conductive feed strip attached to the conductive layer and extending lengthwise within and across at least a portion of a width of the slot; and an L-shaped conductive strip attached to the conductive layer, the L-shaped strip comprising a horizontal portion and a vertical portion, the vertical portion in the plane of the slot and extending substantially parallel to the feed strip, the horizontal portion in the plane of the slot and extending substantially perpendicular to the vertical portion.

* * * * *